US006161788A

United States Patent [19]

Hedlund

[11] Patent Number: 6,161,788

[45] Date of Patent: Dec. 19, 2000

[54] REELING DEVICE

[75] Inventor: Per Niclas Hedlund, Helsingborg, Sweden

[73] Assignee: AB Ph. Nederman & Co., Helsingborg, Sweden

[21] Appl. No.: 09/350,843

[22] Filed: Jul. 9, 1999

[51] Int. Cl.[7] ..... B65H 75/48

[52] U.S. Cl. ..... 242/390.8; 242/381.3; 242/381.6; 242/414.1

[58] Field of Search ..... 242/381, 381.1, 242/381.3, 381.4, 381.6, 414, 414.1, 390.8, 390.9

[56] References Cited

U.S. PATENT DOCUMENTS

| | | | |
|---|---|---|---|
| 4,299,249 | 11/1981 | Nederman . | |
| 4,446,884 | 5/1984 | Rader, Jr. . | |
| 4,458,856 | 7/1984 | Mansel-James | 242/381.1 X |
| 4,565,334 | 1/1986 | Ruhl | 242/414.1 X |
| 4,666,102 | 5/1987 | Colbaugh et al. | 242/390.9 |
| 5,007,599 | 4/1991 | Forsyth | 242/414 X |
| 5,053,586 | 10/1991 | Hansson | 242/381 X |
| 5,402,551 | 4/1995 | Workhoven et al. | 242/390.8 X |

FOREIGN PATENT DOCUMENTS 0295231 12/1988 European Pat. Off. .

1383276 2/1975 United Kingdom .

*Primary Examiner*—Donald P. Walsh
*Assistant Examiner*—William A. Rivera
*Attorney, Agent, or Firm*—Tarolli, Sundheim, Covell, Tummino & Szabo L.L.P.

[57] ABSTRACT

A reeling device for hoses and/or cables, wherein the reeling device (1) includes a rotatable member (3) which is rotated during unwinding or reeling of the hose and/or cable (4) and wherein a spring device (5) is provided to cooperate with the rotatable member (3) such that the spring device (5) a) is stretched when the rotatable member (3) is rotated in an unwinding direction (AR) when the hose and/or cable (4) is pulled out from the reeling device (1), and b) after pulling out the hose and/or cable (4) from the reeling device (1) rotates the rotatable member (3) in a reeling direction (UR) for reeling the hose and/or cable (4) on the reeling device (1). An electric machine (8) is provided to be driven or operated by the rotatable member (3) when the spring device (5) rotates said rotatable member (3) in the reeling direction (UR) such that the electric machine (8) generates electric energy. The electric machine (8) cooperates with an electric loading device (11) which is provided to receive and consume electric energy generated by the electric machine (8) for braking or slowing down the rotatable member (3) such that the spring device (5) is prevented from imparting to said rotatable member (3) an undesired high speed of rotation in the reeling direction (UR).

10 Claims, 2 Drawing Sheets

REELING DEVICE

TECHNICAL FIELD

The present invention relates to a reeling device for elongated, flexible members such as hoses and/or cables, wherein the reeling device includes a rotatable member which is rotated during unwinding or reeling of the hose and/or cable and wherein a spring device is provided to cooperate with the rotatable member such that the spring device a) is stretched when the rotatable member is rotated in an unwinding direction when the hose and/or cable is pulled out from the reeling device, and b) after pulling out the hose and//or cable from the reeling device rotates the rotatable member in a reeling direction for reeling the hose and//or cable on the reeling device.

BACKGROUND OF THE INVENTION

Reeling devices of the abovementioned type are already known from U.S. Pat. No. 4,299,249. At these reeling devices, the spring device increases the reeling speed of the rotatable member such that the retracting speed of the hose and/or cable is highest at the end of the reeling procedure. Because of the increasing reeling speed of the rotatable member, the retracting speed of the hose is also increased and can be very high at reeling devices with long hoses or cables and thereby, powerful spring devices, which might cause various problems. Thus, a hose stop means at the end of the hose might with great power hit or bang into an outlet housing through which the hose passes, with the risk of damaging the outlet housing or the risk of the reeling device loosening from its attachments or brackets. There is also a risk that a hose being retracted at high speed might hit and cause injuries on to a person.

SUMMARY OF THE INVENTION

The present invention discloses a reeling device for an elongated, flexible member. The reeling device comprises a rotatable member that is rotated in a first direction for unwinding the elongated, flexible member and is rotated in a second direction for reeling the elongated, flexible member onto the rotatable member. A spring is attached to the rotatable member. The spring stretches when the rotatable member is rotated in the first direction. After being rotated in the first direction, the spring causes the rotatable member to rotate in the second direction. At least one electric machine is driven by the rotation of the rotatable member in the second direction. The electric machine, when driven, generates electrical energy. The reeling device further comprises at least one electric loading device for slowing the rotation of the rotatable member in the second direction. The electric loading device receives and consumes the electrical energy generated by the electric machine.

BRIEF DESCRIPTION OF THE DRAWINGS

The invention will be further described below with reference to the accompanying drawings, in which FIG. 1 schematically illustrates a reeling device according to the invention.

DETAILED DESCRIPTION OF THE PREFERRED EMBODIMENT

Figure 1:
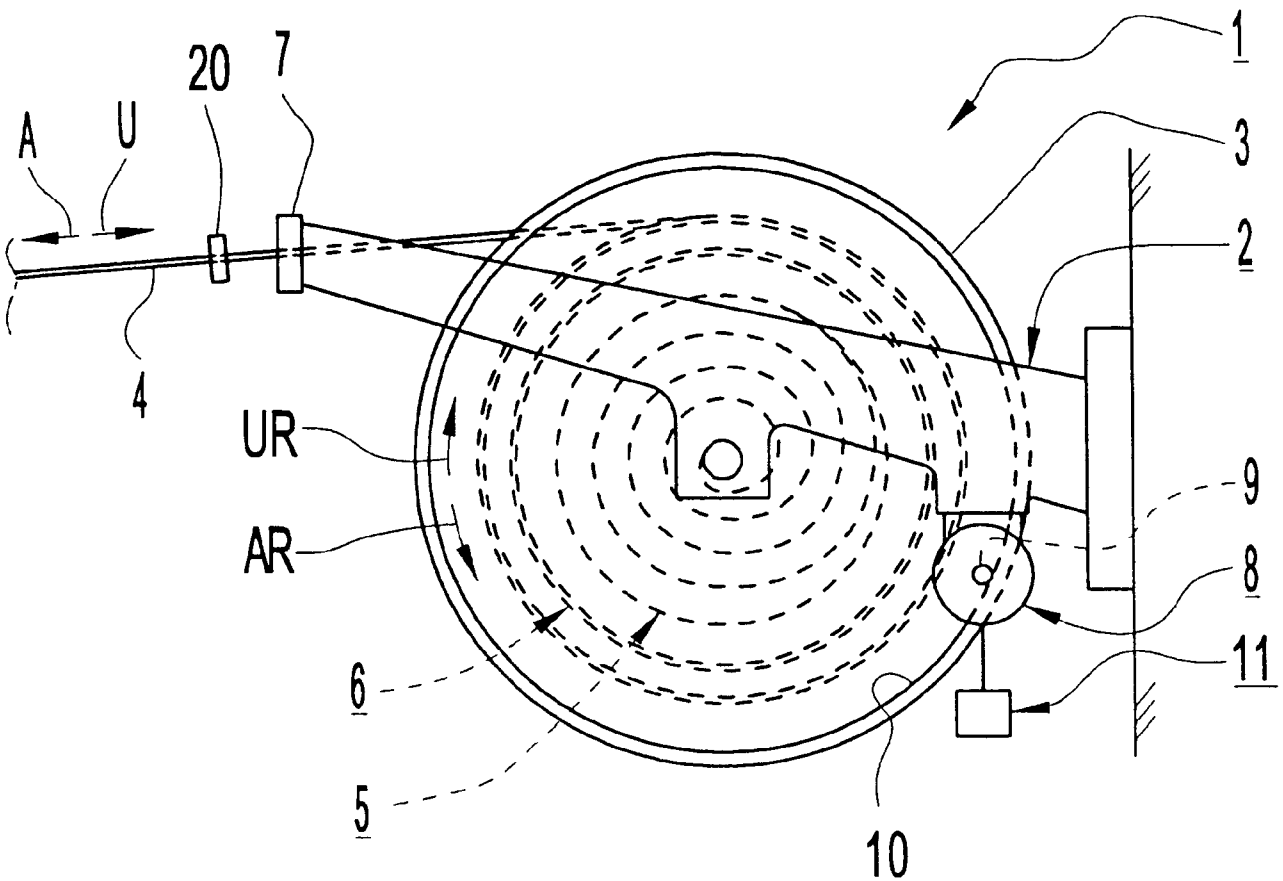
Figure 2:
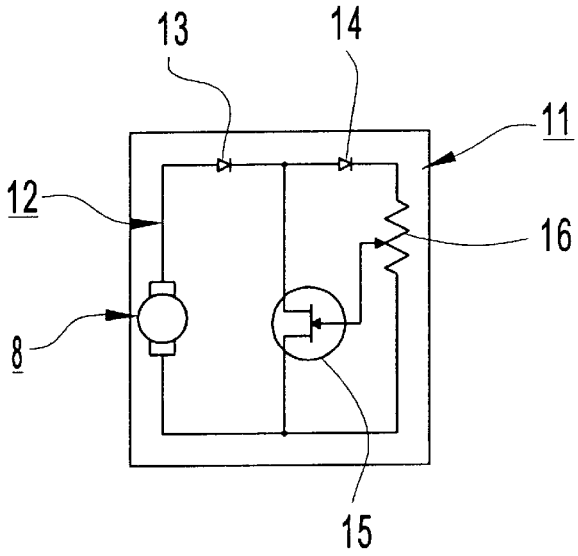
FIG. 2 schematically illustrates an electric circuit in an electric loading device forming part of the reeling device of FIG. 1.

The reeling device 1 illustrated in FIG. 1 includes a support 2 mounted on a wall or any other suitable location and having a rotatable member rotatably mounted thereon, said member being mounted to rotate in an unwinding or unrolling direction as well as in a reeling or wind-up direction. The rotatably mounted member can be a drum 3. On the drum 3 there is provided a hose 4 which by hand or in any other way can be pulled out from the drum 3 in a pulling-out direction A, whereby the drum 3 is rotated in an unwinding or unrolling direction AR. The drum 3 cooperates with a spring device 5 including at least one helical plate spring or a similar spring, which is stretched when the drum 3 is rotated in the unwinding direction AR and which has such spring characteristic that the spring force on the drum 3 increases with the number of revolutions thereof in the unwinding direction AR, i.e. the more the hose 4 is pulled out.

Reeling devices of the abovementioned type are described in said US patent specification 4 299 249 and are therefore not described in more detail here. In such reeling devices there are usually also locking devices 6 which ensure that the hose 4 remains in an extended or pulled out position. The structure and function of these locking devices are also known and therefore, not described in detail, but it should be mentioned that they can be placed in a locking position by discontinue to pull out the hose 4 and they can be released from this locking position by quickly pulling ou t or snatching the hose 4 a short distance in the pulling-out direction A, whereupon the spring devices can rotate the drum 3 in a reeling or wind-up direction UR for retracting the hose 4 in a retracting direction U. The retraction of the hose 4 and thereby, the rotation of the drum 3 in the reeling direction UR, is stopped when a hose stop means 20 on the end portion of the hose 4 hits a member 7 located on the support 2, e.g. a so called outlet housing, through which the hose 4 passes. Since the spring device 5 has the abovementioned spring characteristic, it will increase th e speed of rotation of the drum 3 in the reeling direction UR as the hose 4 is reeled or wound up thereon.

An electric brake device is provided for braking the speed of rotation of the drum 3 when said drum is rotated in the reeling direction UR such that the spring device 5 is prevented from imparting to the drum 3 an undesired high speed of rotation in said reeling direction UR. This electric brake device includes an electric machine 8, preferably an electrically operated motor being in generator operation, mounted on the support 2. This electric motor 8 has an output shaft with a gear wheel 9 or similar in movement transferring engagement with a gear ring 10 or similar on the drum 3 for transfer of the rotary movement of said drum 3 to the electric motor 8 such that said motor is operated to generate electric energy. The gear ring 10 is preferably located at such peripheral portions of the drum 3 which have a higher speed of rotation than central portions thereof. Hereby, the rotary movement of the drum 3 does not need to be changed up for driving such motors 8 which must be operated or driven at a certain minimum speed of rotation for generating sufficient electric energy as required in this application.

The electric motor 8 cooperates with an electric loading device 11 receiving and consuming electric energy generated by said electric motor 8, such that the speed of rotation of the drum is slowed down or lowered when said drum is rotated by the spring device 5 in the reeling direction UR, i.e. when the hose 4 is retracted in the retracting direction U. The consumption of the electric energy occurs by, inter alia, transforming it to thermal energy. The electric loading device 11 may be an electric circuit 12 connected to the electric motor 8, said electric circuit being illustrated in FIG.

2. This electric circuit 12 includes two diodes 13, 14, a transistor 15 and a potentiometer 16, and it operates such that the transistor 15 is activated when the electric energy generated by the electric motor 8, i.e. the forward voltage through the diodes 13, 14, at a certain current reaches or exceeds a predetermined threshold value which is chosen in dependence of the desired maximum speed of rotation of the drum 3 in the reeling direction UR. When the voltage reaches or exceeds said threshold value, electric conduction occurs with loading of the electric motor 8 and consequently, slowing down of the drum 3. This means that when the spring device 5 rotates the drum 3 in the reeling direction UR and has imparted said maximum speed of rotation thereon, the electric motor 8 generates a voltage which exceeds said threshold value, whereby the electric motor 8 is loaded and the drum 3 slowed down such that its speed of rotation does not increase. Instead, the hose 4 will be retracted by the spring device 5 at a suitable maximum speed until the hose stop means 20 provided on the hose 4 hits the support member 7.

Said threshold value can be varied by means of said potentiometer 16.

Figure 3:
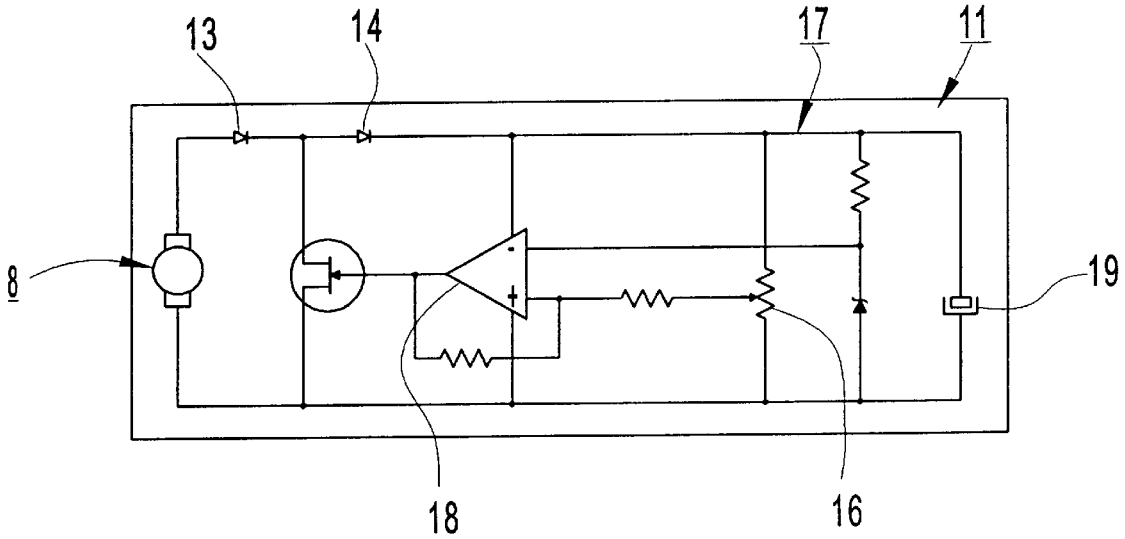
FIG. 3 schematically illustrates a modified embodiment of an electric circuit in an electric loading device forming part of the reeling device of FIG. 1.

FIG. 3 illustrates a modified embodiment of the electric loading device 11. This alternative embodiment includes an electric circuit 17 which is connected to the electric motor 8 and which, as the electric circuit 12, has two diodes 13, 14, a transistor 15 and a potentiometer 16, but also a control circuit 18 and a capacitor 19. In this embodiment, a control voltage is accumulated in the capacitor 19 and can be fed therefrom to the transistor 15 via the control circuit 18 which has a variable threshold through the potentiometer 16. This electric circuit 17 makes it possible to control and brake or slow down the drum 3 when it is rotated at speeds which are too low to permit control and braking by means of the circuit 12.

The diodes 13, 14 in both the electric circuits 12, 17 permit braking or reduction of the rotary speed of the drum 3 only when said drum 3 is rotated in the reeling or wind-up direction UR and not in the unwinding or unrolling direction AR.

The electric machine 8 can be an electric motor in the form of a DC motor or as an alternative thereto, a generator.

The reeling device described above may vary within the scope of the subsequent claims. Within the scope thereof, the electric loading device 11 may consist of other electric circuits than those described, the electric machine 8 may cooperate with central portions of the drum 3, e.g. through a gear mechanism which changes up the rotary s peed of said central portions, and the drum 3 may be adapted for reeling one or more hoses and/or one or more cables, whereby the hoses may be e.g. hoses for the supply of liquids or gases to work places or extraction of gases from work places or exhaust pipes for vehicles.

The reeling device may include another rotatable member 3 than a drum. Thus, the rotatable member 3 may instead consist of an arm (not shown) which rotates relative to a non-rotatable reeling and unwinding member. When the hose 4 is pulled out from the reeling device, said arm is rotated relative to the reeling and unwinding member. For reeling or wind-up, the arm is rotated by means of the spring device 5 such that the hose 4 is wound-up on said reeling and unwinding member.

What is claimed is:

1. A reeling device for an elongated, flexible member comprising:

a rotatable member being rotated in a first direction for unwinding the elongated, flexible member and being rotated in a second direction for reeling the elongated, flexible member onto the rotatable member;

a spring being attached to the rotatable member, the spring stretching when the rotatable member is rotated in the first direction, after being rotated in the first direction the spring causing the rotatable member to rotate in the second direction;

at least one electric machine being driven by the rotation of the rotatable member in the second direction, the electric machine when driven generating electrical energy; and at least one electric loading device for slowing the rotation of the rotatable member in the second direction, the electric loading device receiving and consuming the electrical energy generated by the electric machine.

2. The reeling device of claim 1 further being defined by:

the electric loading device including an electric circuit having at least one diode and at least one transistor.

3. The reeling device of claim 2 further being defined by:

the electric loading device being activated to consume the electrical energy generated by the electric machine when the electrical energy at least reaches a predetermined threshold value that is dependent upon a desired maximum speed of rotation of the rotatable member in the second direction.

4. The reeling device of claim 3 further being defined by:

the electric circuit including at least one potentiometer for changing the predetermined threshold value.

5. The reeling device of claim 2 further being defined by:

the electric circuit including at least one capacitor, at least one control circuit, and at least one transistor, the capacitor accumulating electrical energy generated by the electric machine and feeding the electrical energy through the control circuit to the transistor for consuming electrical energy generated by the electric machine during a low speed rotation of the rotatable member in the second direction.

6. The reeling device of claim 5 further being defined by:

the control circuit being activated when the electrical energy generated by the electric machine at least reaches a predetermined threshold value that is dependent upon a desired maximum speed of rotation of the rotatable member in the second direction, and at least one potentiometer for changing the predetermined threshold value.

7. The reeling device of claim 1 further being defined by:

the rotatable member being a drum with central portions and peripheral portions, a gear ring being located adjacent the peripheral portions of the drum, and the electric machine having a gear wheel mounted on an output shaft, the gear wheel of the electric machine being driven by the gear ring of the rotatable member.

8. The reeling device of claim 1 further being defined by:

the electric machine being an electric motor in generator operation.

9. The reeling device of claim 8 further being defined by:

the electric motor being a DC motor.

10. The reeling device of claim 1 further being defined by:

the electric motor being a generator.

* * * * *